United States Patent [19]

Kasada

[11] Patent Number: 4,634,367

[45] Date of Patent: Jan. 6, 1987

[54] CARBURETION TYPE BURNING APPARATUS

[75] Inventor: Toshio Kasada, Gunma, Japan

[73] Assignee: Mitsubishi Denki Kabushiki Kaisha, Tokyo, Japan

[21] Appl. No.: 783,179

[22] Filed: Oct. 2, 1985

[30] Foreign Application Priority Data

Oct. 15, 1984 [JP] Japan ..... 59-215822

[51] Int. Cl.[4] ..... F23N 5/00

[52] U.S. Cl. ..... 431/29; 431/18; 431/208

[58] Field of Search ..... 431/18, 29, 86, 208

[56] References Cited

U.S. PATENT DOCUMENTS 4,392,812 7/1983 Yoshii ..... 431/208 X 4,543,056 9/1985 Sakakibara ..... 431/29 X

FOREIGN PATENT DOCUMENTS 37624 3/1982 Japan ..... 431/29

*Primary Examiner*—Randall L. Green

*Attorney, Agent, or Firm*—Oblon, Fisher, Spivak, McClelland & Maier

[57] ABSTRACT

A carburetion type burning apparatus comprises a fuel tank, a pump for feeding fuel in the tank, a carburetion chamber for evaporating the fuel, a nozzle for ejecting fuel gas from the carburetion chamber, a burner and a needle for opening and closing the nozzle, in which the needle closes the nozzle at a predetermined time after operation of the pump in stopped.

6 Claims, 6 Drawing Figures

CARBURETION TYPE BURNING APPARATUS

BACKGROUND OF THE INVENTION

1. Field of the Invention

The present invention relates to a carburetion type burning apparatus for evaporating liquid fuel such as kerosene for burning.

2. Description of Prior Art

A conventional carburetion type burning apparatus will be described with reference to FIG. 5.

In FIG. 5, reference numeral 1 designates a fuel tank, and numeral 2 designates an electromagnetic pump for feeding kerosene contained in the fuel tank 1 into a carburetion chamber 4 in a carburetor 3 through a fuel pipe 18. Numeral 5 designates a carburetion stabilizing substance provided in the carburetion chamber 4. Numeral 6 designates a heater which maintains the temperature in the carburetion chamber 4 constant during the burning operation with the aid of a thermister 7 attached to a side wall of the carburetor 3 and a control circuit (not shown). A nozzle orifice 8 is formed above the carburetion chamber 4. A burner 9 is provided facing the nozzle orifice 8. There are arranged on or above the burner an ignition plug 10 for igniting the fuel gas and a flame rod 11 to detect an ion current in the flames.

Reference numeral 12 designates a needle having a sharp point for opening and closing the nozzle orifice. Numeral 13 is a movable piece formed integrally with the needle 12. Numeral 14 designates a solenoid which causes a sliding movement of the movable piece 13. Numeral 15 designates a spring for urging the movable piece 13 toward the right in the drawing to open the nozzle orifice 8 when the solenoid 14 is not actuated. Numeral 16 designates a return valve attached integrally with the movable piece 13 to prevent the kerosene from flowing into a pipe 17 which is in communication with the fuel tank 1 when the nozzle orifice 8 is opened.

The movable piece 13 is moved toward the left in the drawing against the spring 15 when solenoid 14 is actuated to securely close the nozzle orifice 8 with the needle 12, and the return valve 16 is opened to recover the kerosene remaining in the carburetion chamber 4 which flows into the fuel tank 1 through the pipe 17.

The operation of a conventional burning apparatus will be described with reference to the time chart in FIG. 6.

When an operation switch (not shown) is turned on, the carburetor 3, the carburetion chamber 4 and the carburetion stabilizing substance 5 are heated by the heater 6 so that the carburetion chamber 4 is preheated at a predetermined temperature (250° C.–300° C.) which is required to evaporate the kerosene. Since the kerosene deposited in the carburetion chamber 4 is partially evaporated in this preheating period, a bad smell is produced from the nozzle orifice 8. To avoid the smell, the nozzle orifice 8 is closed with the needle 12 by actuating the solenoid 14. Upon completion of the preheating operation when the temperature of the carburetion chamber 4 reaches the predetermined level, the electromagnetic pump 2 is actuated, and kerosene is supplied from the fuel tank 1 through the pipe 18 to the carburetion chamber 4 where it is heated to become fuel gas.

At that moment, current to the solenoid 14 is stopped and the needle 12 is slidingly moved to open the nozzle orifice 8, whereby the fuel gas is ejected through the nozzle orifice 8. In this case, air for combustion is sucked from the environment of the nozzle to make a gas mixture. The gas mixture is then introduced in the burner 9. An ignition plug 10 mounted on the burner 9 produces an electric discharge at the same time as the completion of the preheating period. The gas mixture is ignited by a spark in the electric discharge. After ignition, an ion current in the flames is detected by the flame rod 11. When the ion current reaches a predetermined level or higher, the discharge of the ignition plug is stopped by a control circuit (not shown).

In the burning operation, the heater 6 is controlled so that the temperature in the carburetion chamber 4 is maintained at a constant level by the aid of the thermister 7 and the control circuit, so that warm air is supplied to a room by the operation of a well-known convection fan (not shown).

When the burning operation is to be stopped, the operation switch is turned off. Then, the electromagnetic pump 2 is stopped to stop the supply of kerosene. At the same time, the solenoid 14 is actuated by a current to close the nozzle orifice 8 with the needle 12. Then, the return valve is opened so that the fuel gas remaining in the carburetion chamber 4 condenses while it passes through the space around the needle 12 and the movble piece 13. The liquid fuel thus produced is recovered in the fuel tank 1 through the pipe 17.

Current to the heater 6 is also stopped at this time. Accordingly, the temperature in the carburetion chamber 4 decreases and the fuel gas remaining in the chamber becomes liquid.

When the nozzle orifice 8 is opened by deenergizing the solenoid 14 after a time period sufficient to reduce the temperature of the carburetion chamber 4, there is only a small amount of fuel gas remaining in the carburetion chamber 4. Therefore, the leakage of fuel gas, which causes a bad smell, from the nozzle orifice 8 is prevented. The convection fan is also stopped at the same time that the fire is extinguished.

In a conventional carburetion type burning apparatus having the construction as abovementioned, the nozzle orifice 8 is closed when the fuel gas fills the carburetion chamber 4 and the fire is extinguished. Accordingly, the fuel gas is condensed into liquid fuel causing a large amount of kerosene to remain in the carburetion chamber 4 and to be recovered in the fuel tank 1 through the pipe 17.

As is well-known, kerosene heated at a high temperature is easily oxidized and easily produces tar (carbide), whereby a large amount of tar deposits and accumulates on the inner wall of the carburetion chamber 4 and on the carburetion stabilizing substance 5. As the deposition of the tar increases, the carburetion of the kerosene is hindered causing a deterioration of the burning condition.

SUMMARY OF THE INVENTION

It is an object of the present invention to provide a carburetion type burning apparatus which minimizes the tar deposited on a carburetion chamber.

The foregoing and the other objects of the present invention have been attained by providing a carburetion type burning apparatus which comprises a needle for opening and closing a nozzle orifice, a carburetion chamber, a fuel tank for receiving fuel, a pump for feeding the fuel to the carburetion chamber from the fuel tank, a burner for burning fuel gas ejected from the nozzle orifice and a needle controlling device for closing the nozzle orifice with the needle following a certain delay time (td) after the fire is extinguished and the supply of liquid fuel by the pump is stopped.

BRIEF DESCRIPTION OF DRAWING

A more complete appreciation of the invention and many of the attendant advantages thereof will be readily obtained as the same becomes better understood by reference to the following detailed description when considered in connection with the accompanying drawings, wherein.

DETAILED DESCRIPTION OF A PREFERRED EMBODIMENT

Figure 1:
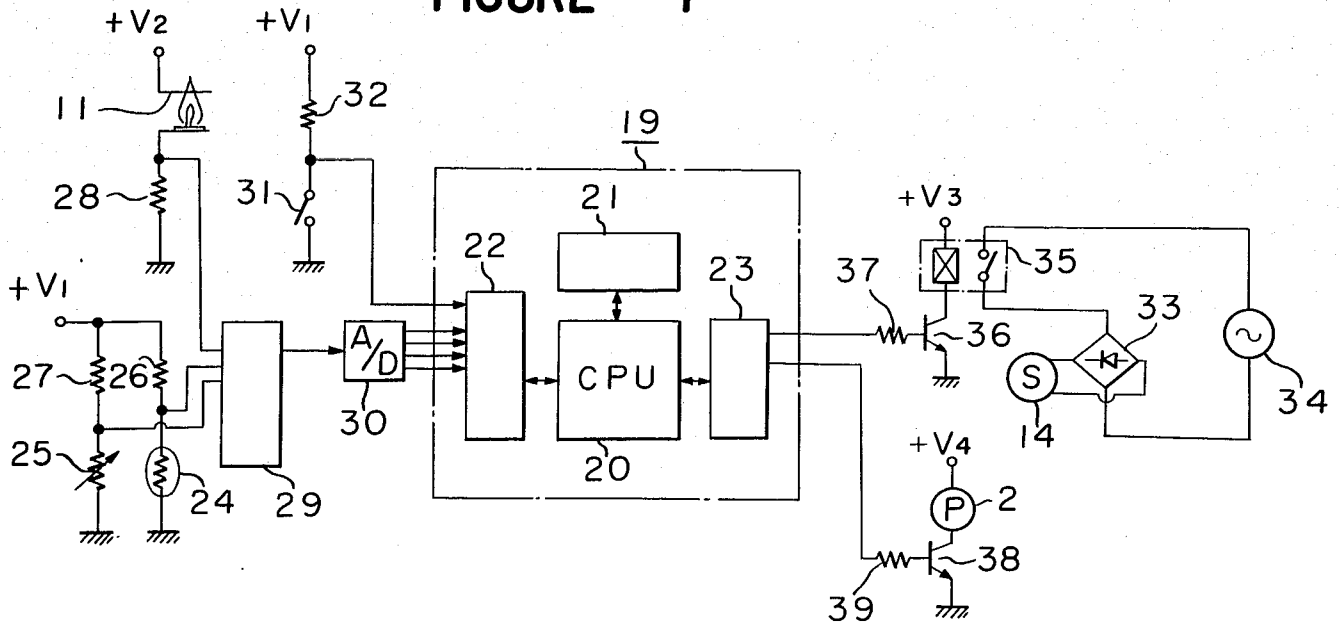
FIG. 1 is a circuit diagram of a first embodiment of the carburetion type burning apparatus according to the present invention.

Various other objects, features and attendant advantages of the present invention will be more fully appreciated as the same becomes better understood from the following detailed description when considered in connection with the accompanying drawings in which like reference characters designate like or corresponding parts throughout the several views and wherein FIG. 1 shows a diagram of the present invention. Reference numeral 19 designates a microcomputer comprising a CPU 20, a memory 21, an input circuit 22 and an output circuit 23. Reference numeral 24 designates a thermister for detecting the temperature in a room, numeral 25 designates a variable resistor for setting the room temperature and numerals 26 and 27 designate resistors respectively connected in series to the thermister 24 and the variable resistor 25.

A flame rod 11 is placed so as to be in contact with the flames when burning takes place. A D.C. voltage+V is applied across the flame rod 11 and the burner 9 to detect an ion current in the flames through the resistor 28. When this current is thus detected, an input signal is supplied to analogue multiplexer 29. The output from the analogue multiplexer 29 is converted into a digital signal by an A/D transducer 30 which becomes an input to the input circuit 22. Reference numeral 31 designates the operation switch and numeral 32 designates a resistor connected in series with the operation switch 31. The resistor 32 inputs information as to the ON or OFF state of the operation switch 31 in the input circuit 22.

Numeral 14 designates a solenoid, and numeral 33 designates a diode bridge for performing full-wave rectification of a commercial power source 34. Numeral 35 designates a relay for the solenoid. Numerals 36 and 37 respectively designate a transistor and resistor which control the on-off operations of the relay 35 depending on a signal from the output circuit 23. Numeral 2 designates an electromagnetic pump. Numerals 38 and 39 respectively designate a transistor and a resistor which amplify the signal of the output circuit 23 to actuate the electromagnet pump 2. The speed of operation of the pump 2 is dependent on the frequency of the on-off operations of the transistor 38 to thereby control the amount of kerosene to be supplied.

The operation of the present invention will be described with reference to FIGS. 2 to 5.

Figure 2:
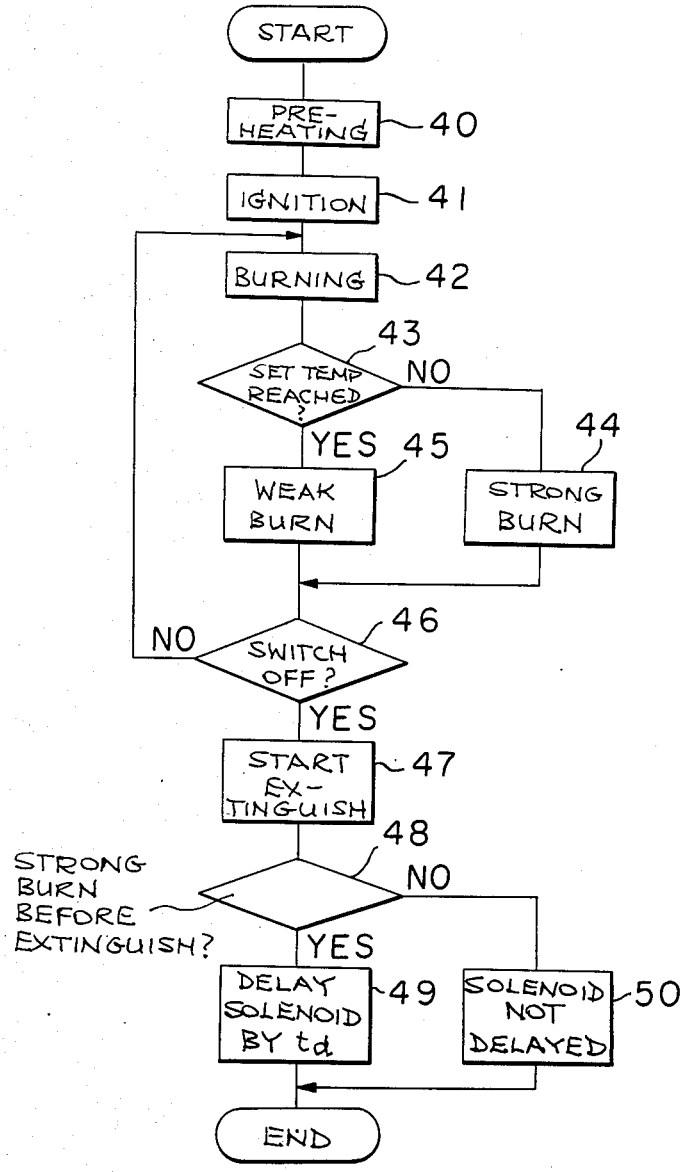
FIG. 2 is a flow chart showing control of the operation of the first embodiment of the present invention.
Figure 3:
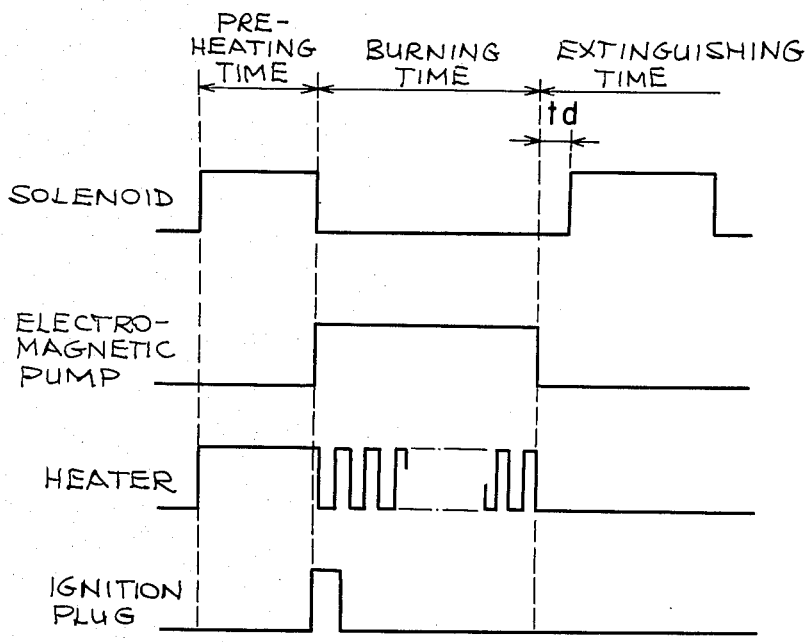
FIG. 3 is a diagram showing timing of the operation of the first embodiment.
Figure 4:
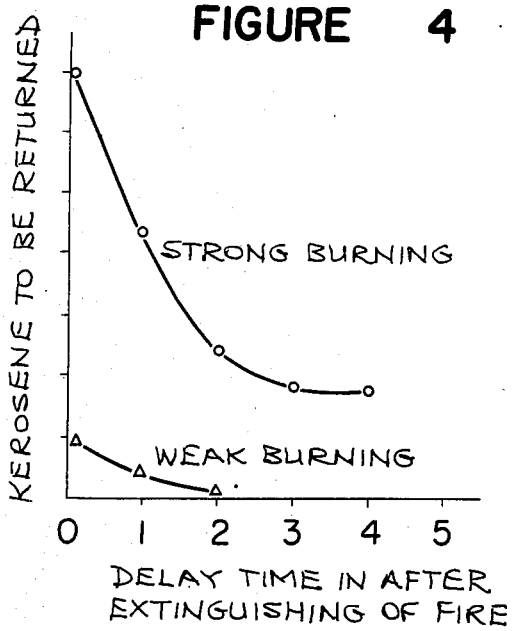
FIG. 4 is a graph showing a relation between an amount of kerosene to be returned and delay time.
Figure 5:
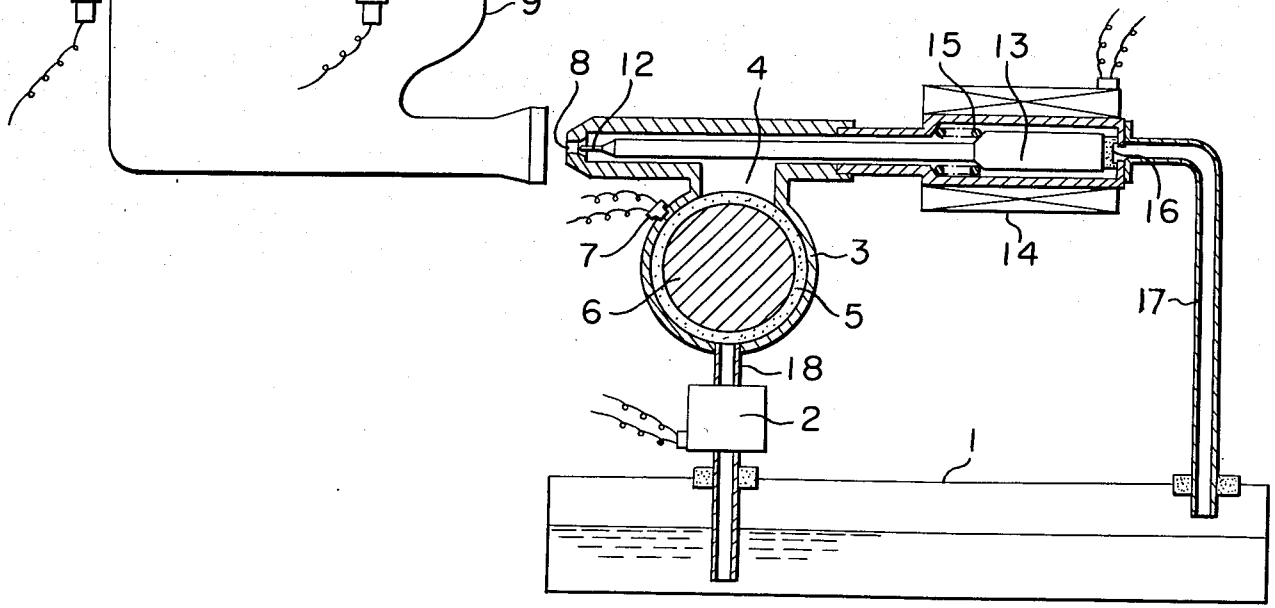
FIGURE 5 PRIOR ART
FIG. 5 is a diagram of the construction of a conventional carburetion type burning apparatus.
Figure 6:
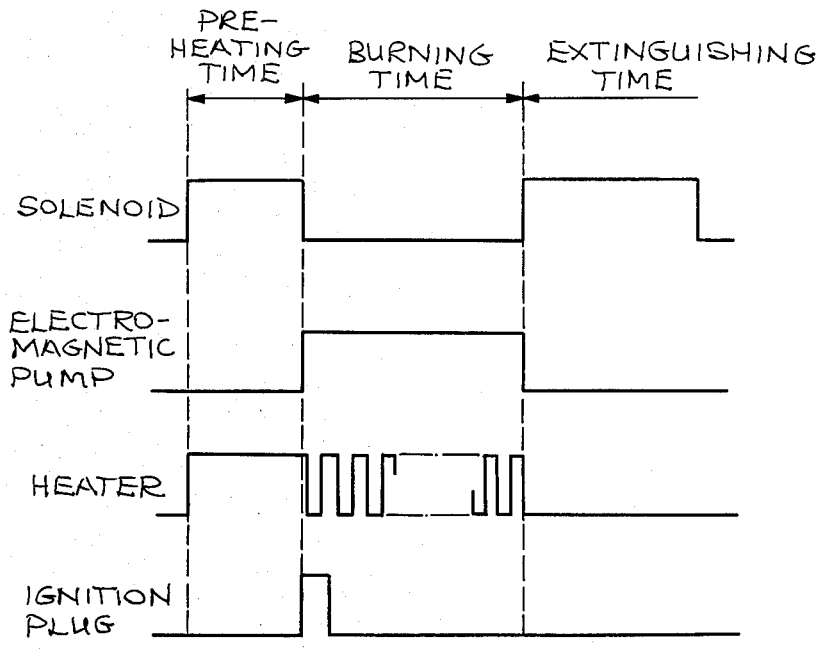
FIGURE 6 PRIOR ART
FIG. 6 is a diagram showing timing of the operation in the conventional apparatus.

FIG. 2 is a flow chart showing a part of a control program stored in the memory 21 of the microcomputer 19; FIG. 3 is a diagram showing the timing of the operations of the solenoid and other parts, and FIG. 4 is a graph showing a relation between the delay time in the operation of the solenoid after extinguishing the fire and the amount of kerosene to be returned.

When the operation switch 31 is turned on, a signal representing an ON state of the switch is provided to the input in the input circuit 22 to start preheating step 40 in FIG. 2. On completion of the preheating step 40, an ignition step 41 and a burning step 42 sequentially occur. The description concerning these steps is omitted because these steps are the same as in the conventional apparatus.

In the burning step 42, the temperature in a room is always detected by the thermister 24 and the signals detected are stored in the memory 21 through the input circuit 22.

On the other hand, a set temperature determined by the variable resistor 25 is also stored in the memory 21. The room temperature is compared with the set temperature at step 43, and when a room temperature is lower than the set temperature, a strong burning operation is instructed at step 44. Then, the electromagnetic pump 2 is operated at a high speed to increase the amount of kerosene to be supplied, hence the amount of heat provided increases. When the room temperature rises so as to be greater than or equal to the set temperature, a weak burning operation is instructed at step 45 so that the electromagnetic pump is operated at low speed, causing a small amount of kerosene to be supplied and the heat to decrease.

In order to extinguish the fire, when the operation switch 31 is turned off, an OFF signal from the operation switch 31 is input to the input circuit 22. The presence of the OFF signal is determined at step 46. If yes, the extinguishing operation begins at step 47 to stop the electromagnetic pump 2 and the convection fan simultaneously. In this case, actuation of the solenoid 14 does not take place until a given time (td) has lapsed after the electromagnetic pump 2 has been stopped as shown in the time chart of FIG. 3. Accordingly, the fuel gas in the carburetion chamber 4 is ejected from the nozzle orifice 8 to be burned in the burner 9 during this time period (td) after the electromagnetic pump 2 has been stopped.

After the delay time (td), current is provided to the solenoid 14 so that the nozzle orifice is closed by the needle 12. However, there is substantially no fuel gas left in the carburetion chamber 4 and only a small amount of kerosene is recovered in the fuel tank 1 through the pipe 17 since the fuel gas is discharged through the nozzle orifice 8 during the time (td) after stoppage of the operation of the electromagnetic pump 2.

FIG. 4 is a graph obtained by experiments in which an amount of kerosene to be recovered through the pipe 17 is measured when the delay time (td) is changed. The graph shows that the amount of kerosene to be returned is reduced to one third at td=2 seconds in the strong burning operation and the amount of kerosene is negligible at td=2 seconds in the weak burning operation. However, in the weak burning operation in which an amount of kerosene to be supplied is small and td=2 seconds, there may be a problem that the fuel gas to be ejected through the nozzle orifice 8 is exhausted before closing the nozzle orifice 8. This extinguishes the fire in the burner 9 thereby causing a bad smell. This problem can be overcome by the time (td) depending on the burning condition just before extinguishing the fire as shown in the flow chart in FIG. 2.

In FIG. 2, the burning operation just before extinguishing the fire is judged based on data stored in the memory 21 at step 48. In the case of strong burning operation, the nozzle orifice 8 is closed by feeding a current to the solenoid 14 at the time (td) after stoppage of the electromagnetic pump 2 at step 49. In the case of weak burning operation, the extinguishing operation is finished by closing the nozzle orifice 8 by feeding a current to the solenoid 14 at the same time as the stoppage of the electromagnetic pump 2 at step 50.

A description has been made as to burning apparatus having a two stage switching function, i.e. strong and weak burning operations. However, a burning apparatus having multiple switching function or a stepless switching function may be used by optionally changing the delay time (td) depending on the amount of kerosene to be supplied to the electromagnetic pump.

Thus, in the present invention, the amount of kerosene remaining in the carburetion chamber and to be recovered by the pipe can be made small. Tar deposited and accumulated in the carburetion chamber can be made small. Accordingly, a carburetion type burning apparatus having excellent resistance against tar is obtained.

What is claimed is:

1. A carburetion type burning apparatus which comprises a needle for opening and closing a nozzle orifice, a carburetion chamber, a fuel tank for receiving fuel, a pump for feeding the fuel to said carburetion chamber from said fuel tank, a heater element for vaporizing the fuel, said nozzle orifice receiving said vaporized fuel from said carburetion chamber, a burner for burning fuel gas ejected from said nozzle orifice and a needle controlling device for closing said nozzle orifice with said needle following a delay time after the fire is extinguished and the pump is stopped, said delay time being varied depending on the rate of supply of liquid fuel immediately before the fire is extinguished.

2. A carburetion type burning apparatus according to claim 1, wherein rate of supply of liquid fuel is carried out based on comparison of a room temperature detected and a set temperature.

3. A carburetion type burning apparatus according to claim 2, wherein when a room temperature is less than a set temperature, said pump is operated at a higher speed and when a room temperature is greater than or equal to a set temperature, said pump is operated at a lower speed.

4. A carburetion type burning apparatus according to claim 1, wherein said delay time (td) after the stoppage of said pump is enough time for fuel gas to escape from said carburetion chamber through said nozzle orifice.

5. A carburetion type burning apparatus according to claim 1, wherein said needle controlling device is a microcomputer having a central processing unit and a memory.

6. A carburetion type burning apparatus according to claim 1, wherein said pump supplies fuel at one of a high and low rate of supply and wherein said delay time is zero when the low rate of supply is utilized.

* * * * *